US005293829A

United States Patent [19]

Mu

[11] Patent Number: 5,293,829

[45] Date of Patent: Mar. 15, 1994

[54] COMPACT HOME USE SEWING MACHINE WITH AN ADJUSTING MECHANISM FOR CONTROLLING THE STITCH LENGTH AND FEED DIRECTION

[76] Inventor: Chong-Ming Mu, 2 Fl., No. 6, Lane 8, Ming Feng Str., Hsi Chih Chen, Taipei Hsien, Taiwan

[21] Appl. No.: 80,780

[22] Filed: Jun. 24, 1993

[51] Int. Cl.[5] ..... D05B 27/22

[52] U.S. Cl. ..... 112/316; 112/323; 112/317

[58] Field of Search ..... 112/169, 220, 303, 314, 112/315, 316, 317, 323

[56] References Cited

U.S. PATENT DOCUMENTS 4,501,213 2/1985 Meier ..... 112/316

5,018,467 5/1991 Jimenez et al. ..... 112/316 X

*Primary Examiner*—Clifford D. Crowder

*Assistant Examiner*—Paul C. Lewis

*Attorney, Agent, or Firm*—Bacon & Thomas

[57] ABSTRACT

A sewing machine including a shuttle/hook & bobbin assembly reciprocated to carry an under thread for making stitches with an upper thread on a workpiece, a stroke-adjustable feed mechanism controlled by a micro-inch stitch adjusting device to feed the workpiece in either direction or to let the workpiece be retained in place during stitching. The major parts of the sewing machine are respectively molded from ABS (acrylonitrile-butadiene-styrene) so that the weight as well as the manufacturing cost of the sewing machine are relatively reduced.

2 Claims, 8 Drawing Sheets

COMPACT HOME USE SEWING MACHINE WITH AN ADJUSTING MECHANISM FOR CONTROLLING THE STITCH LENGTH AND FEED DIRECTION

BACKGROUND OF THE INVENTION

The present invention relates to sewing machines, and more particularly the present invention relates to a compact sewing machine for home use which is lightweight and, which has a stitch adjusting device for adjusting the stitch density steplessly.

The base plate as well as the major mechanical parts of conventional home type sewing machines, including the early treadle-operated sewing machines and the present electric sewing machines, are commonly made of metal. Therefore, conventional sewing machines are commonly heavy. Further, the manufacturing cost of a sewing machine can not be greatly reduced when its major mechanical parts are made from metal. It is a good way to use plastics for making the base plate and the major parts for a sewing machine so as to reduce the manufacturing cost and the machine weight. Because the strength of regular plastics is inferior to metal, sewing machine manufacturers may use plastics for making the outer shell for a sewing machine, however, there is not any sewing machine manufacturer who dares to use plastics for making the major mechanical parts for a sewing machine.

SUMMARY OF THE INVENTION

The present invention has been accomplished under the aforesaid circumstances. It is therefore the major object of the present invention to use ABS (acrylonitrile-butadiene-styrene) for making the major parts for a sewing machine so as to reduce the weight and manufacturing cost of the sewing machine without affecting its performance and durability. It is another object of the present invention to provide a stitch adjusting device for a sewing machine for adjusting the stitch density steplessly.

DETAILED DESCRIPTION OF THE PREFERRED EMBODIMENT

Figure 1:
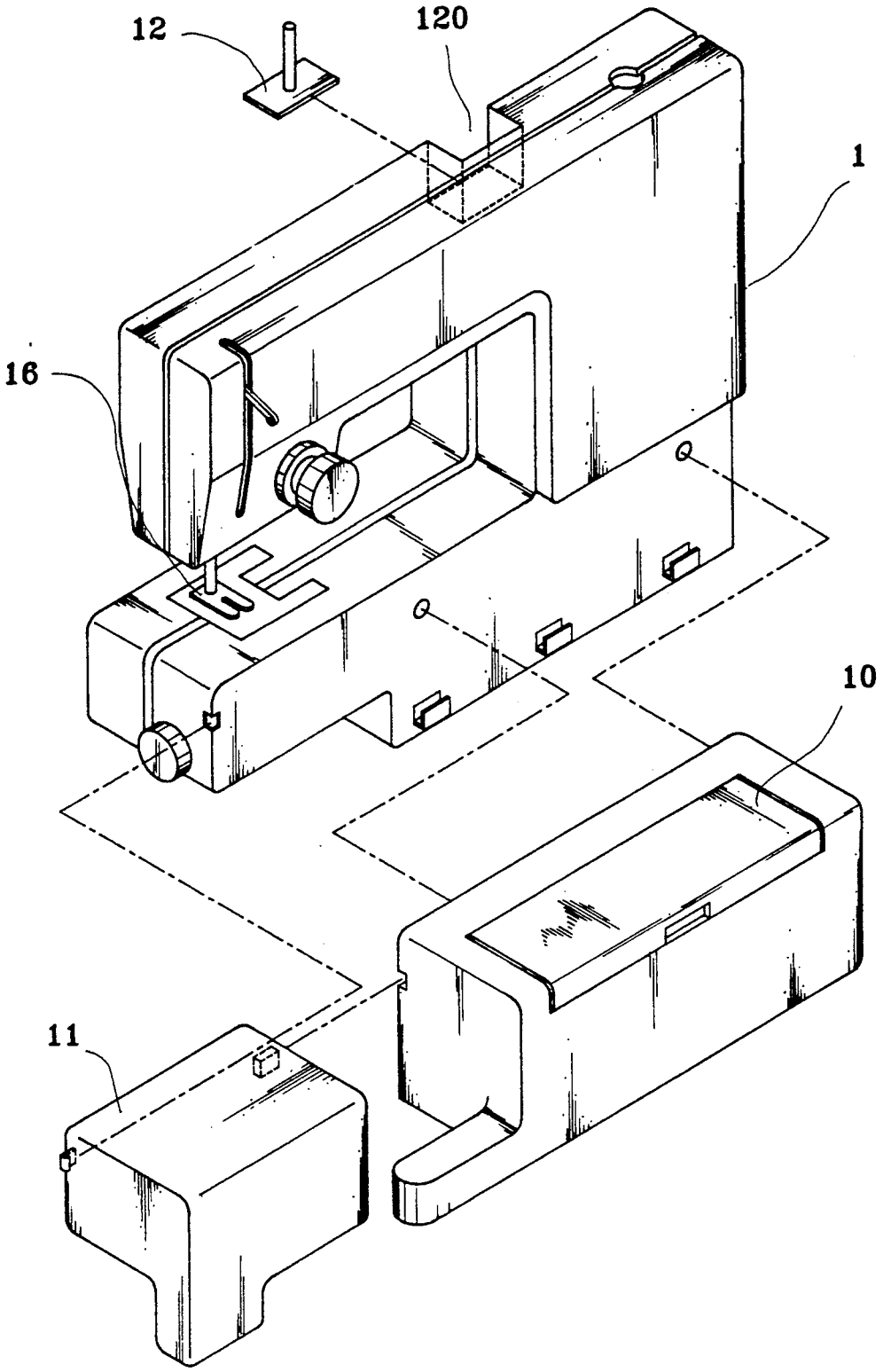
FIG. 1 is a perspective view of a sewing machine according to the preferred embodiment of the present invention (dismantled from a storage case and a darning platform)

Referring to FIG. 1, a storage case 10 and a darning platform 11 are detachably fastened to a sewing machine 1 at one side. The darning platform 11 is disposed in flush with the free arm (darning arm) of the sewing machine for guiding the sleeve or leg being stitched. There is a recessed hole 120 on the top of the outer shell of the sewing machine 1, which receives a spool holder 12 for holding a spool of upper thread. The spool holder 12 can be completely received inside the recessed hole 120 to carry a smaller spool of upper thread, or extended out of the recessed hole 120 to carry a bigger spool of upper thread.

Figure 2:
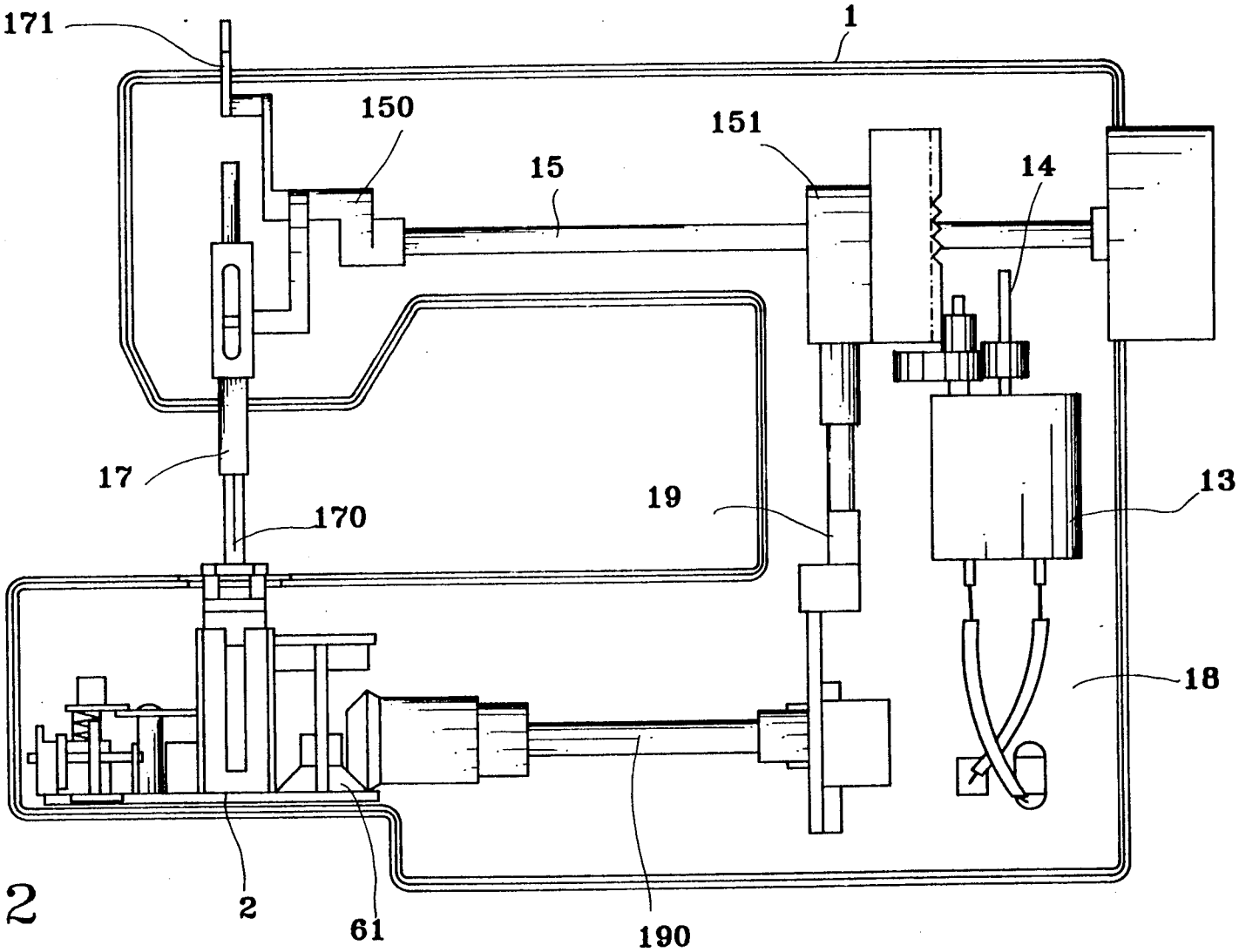
FIG. 2 is a plain view showing the internal structure of the sewing machine.
Figure 7:
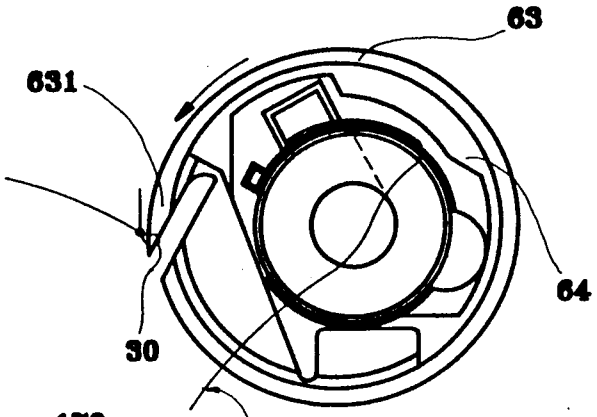
FIG. 7 illustrates the operation of the shuttle/hook & bobbin assembly of the stitch making mechanism (step I)
Figure 7:
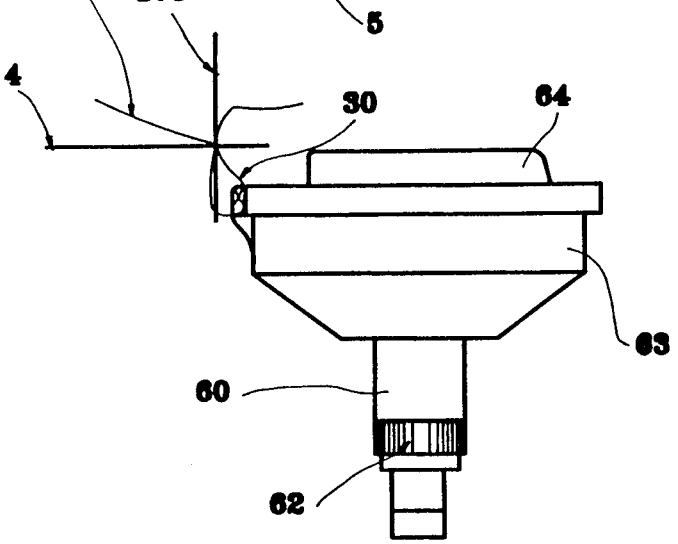

Referring to FIG. 2, therein illustrated is a plain view showing the internal structure of the sewing machine 1. The major parts of the sewing machine 1 are respectively molded from ABS (acrylonitrile-butadiene-styrene). Because ABS is lightweight and superior in structural strength than polyvinyl chloride and other regular polymer plastics, using ABS to make the major parts of the sewing machine greatly reduces the machine weight without affecting its performance and durability. The sewing machine 1 comprises a DC motor 13, a main shaft 15 driven by the DC motor 13 through a reduction gear 14, a crank 150 driven by the main shaft 15 to reciprocate a needle bar 17 and a thread hook 171 vertically, a cam 151 mounted around the main shaft 15 at a suitable location, a reciprocating mechanism 19 received inside the darning arm 18 of the sewing machine 1 and driven by the cam 151 to turn a transmission shaft 190 back and forth alternatively, and a stitch making mechanism 2 disposed below the needle 170 of the needle bar 17 and driven by the transmission shaft 190 to make stitches with the needle 170 of the needle bar 17. As the needle 170 pierces through the workpiece 4 (see FIG. 7), the stitch making mechanism 2 carries the under thread 5 through the loop 30 formed of the upper thread 3 being carried by the needle 170, therefore a stitch is made on the workpiece 4 as the needle 170 is lifted.

Figure 3:
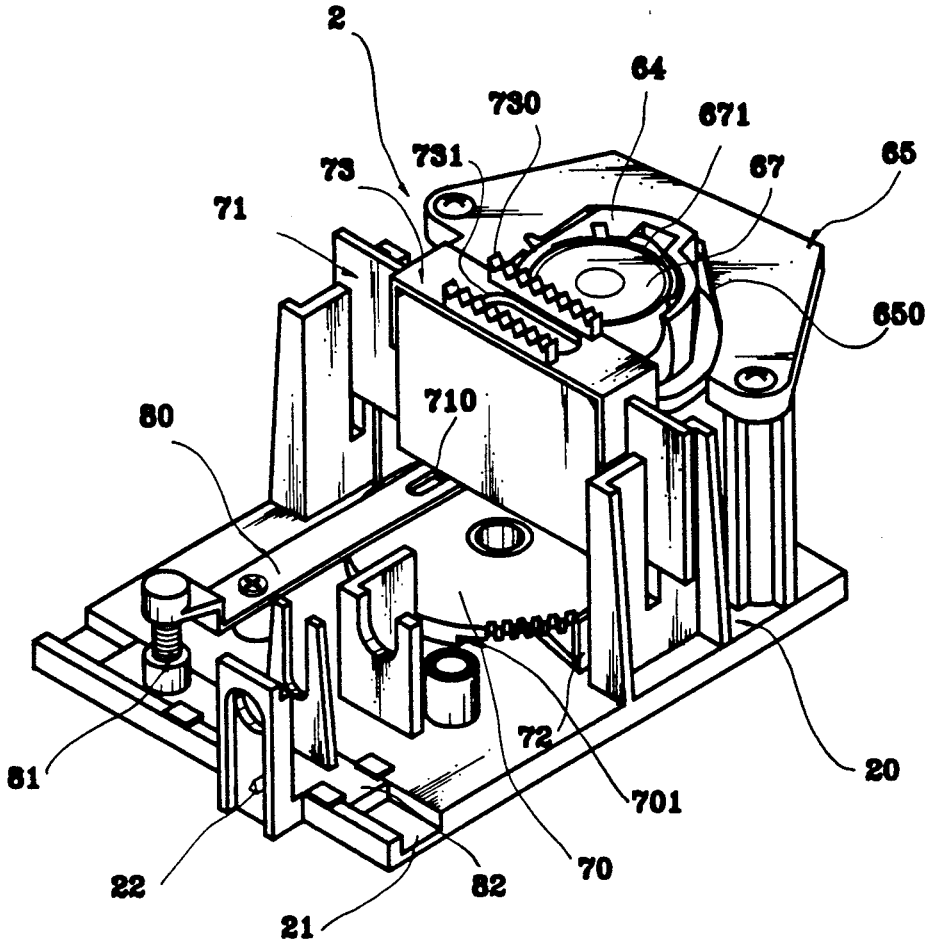
FIG. 3 is a perspective assembly view of the stitch making mechanism of the sewing machine.
Figure 4:
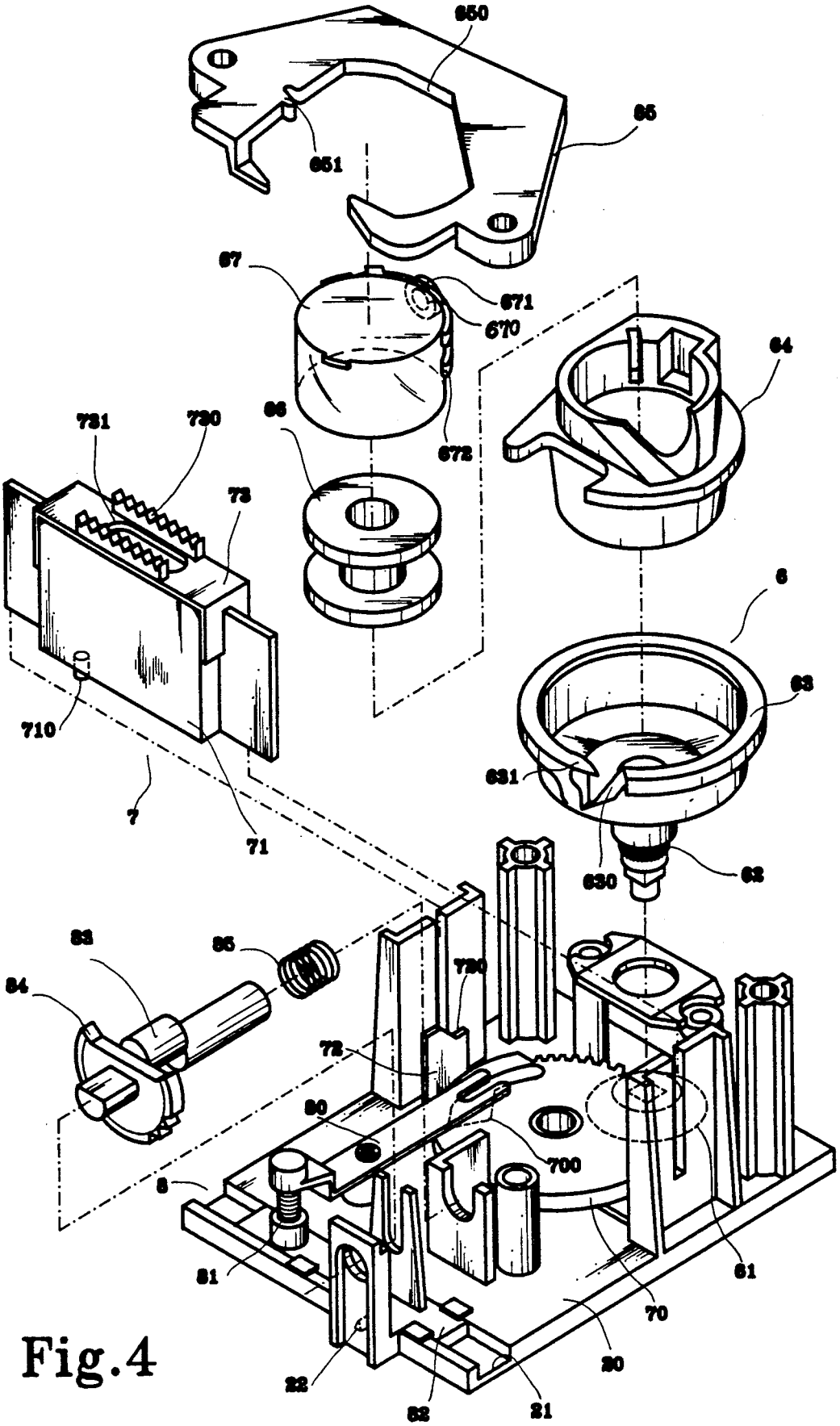
FIG. 4 is an exploded view of the stitch making mechanism.
Figure 5:
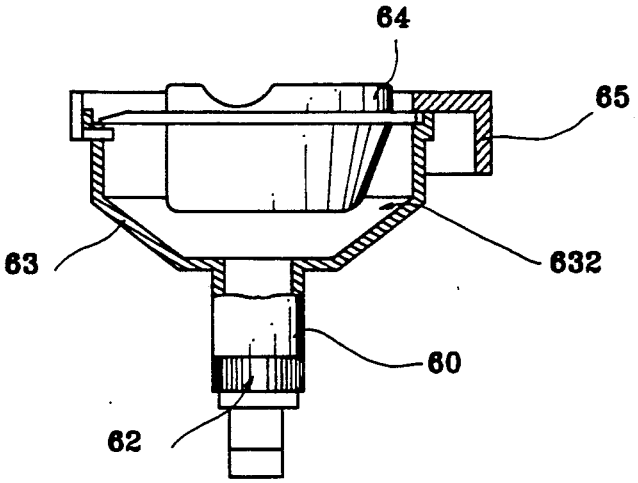
FIG. 5 is a sectional assembly view of the shuttle/-hook & bobbin assembly of the stitch making mechanism.

Referring to FIGS. 3 and 4, the stitch making mechanism 2 comprises a shuttle/hook & bobbin assembly 6, a feed mechanism 7, and a micro-inch stitch adjusting device 8 respectively mounted on a base plate 20 and linked to the transmission shaft 190. The shuttle/hook & bobbin assembly 6 comprises a revolving shaft 60 vertically disposed above the base plate 20, a bevel gear 61 fastened around the revolving shaft 60 at the bottom and meshed with a bevel gear 191 on the transmission shaft 190, a spur gear 62 fastened around the revolving shaft 60 in the middle and linked up with the feed mechanism 7, a rotating shuttle 63 integrally formed on the revolving shaft 60 at the top, which has a notch 630 on the rim thereof and a unitary thread hook 631 projected into the notch 630 along the tangent line, a bobbin case 64 retained in the rotating shuttle 63 by a pressure plate 65 and spaced from the inside wall of the rotating shuttle 63 by a gap 632 (see FIG. 5), a bobbin cap 67 disposed within the bobbin case 64, and an under thread bobbin 66 received inside the bobbin cap 67. The pressure plate 65 comprises a substantially C-shaped opening 650 fitting over the periphery of the bobbin case 64, and a projecting rod 651 projected into the opening 650 to stop the bobbin case 64 from escaping out of the rotating shuttle 63. Therefore, the under thread 5 can be carried out of the C-shaped opening 650 for making stitches with the upper thread 3 (see FIG. 7).

Figure 6:
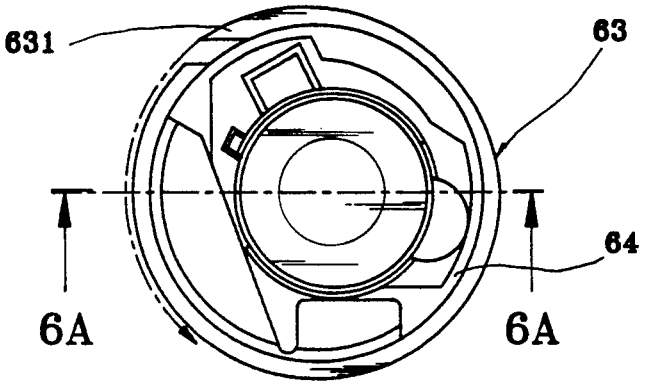
FIG. 6 is a top view of the shuttle/hook & bobbin assembly of the stitch making mechanism.
Figure 6A:
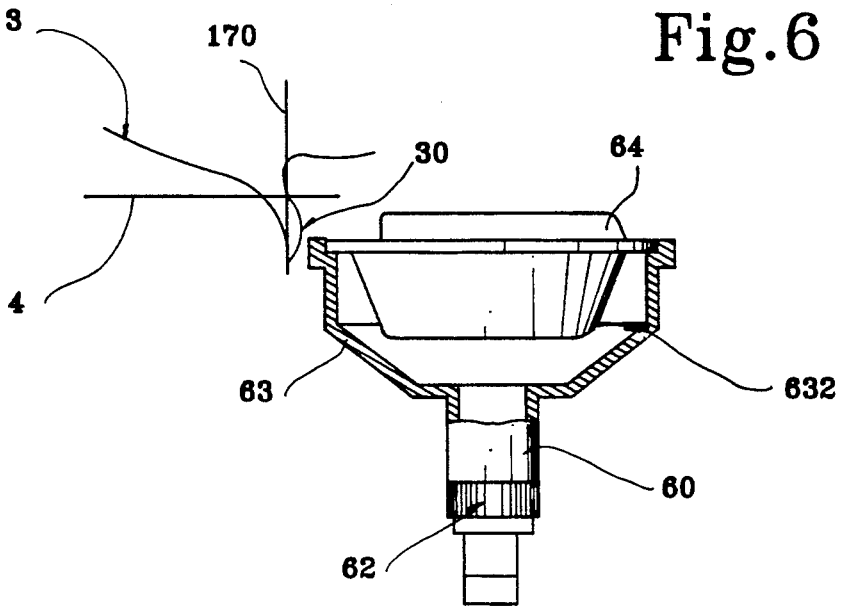
FIG. 6A is a cross section taken along line 6A—6A of FIG. 6.
Figure 8:
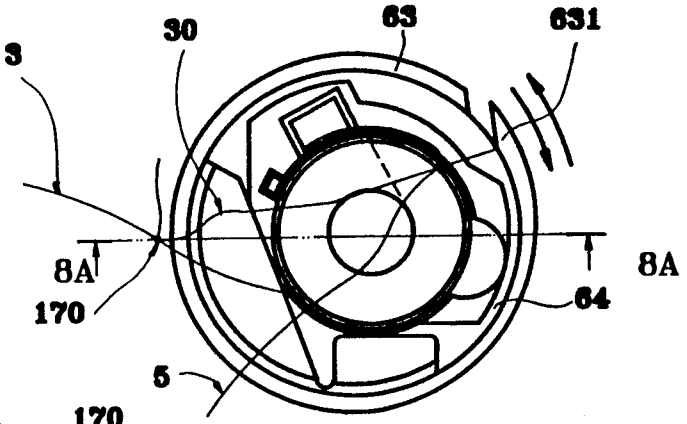
FIG. 8 illustrates the operation of the shuttle/hook & bobbin assembly of the stitch making mechanism (step II)
Figure 8A:
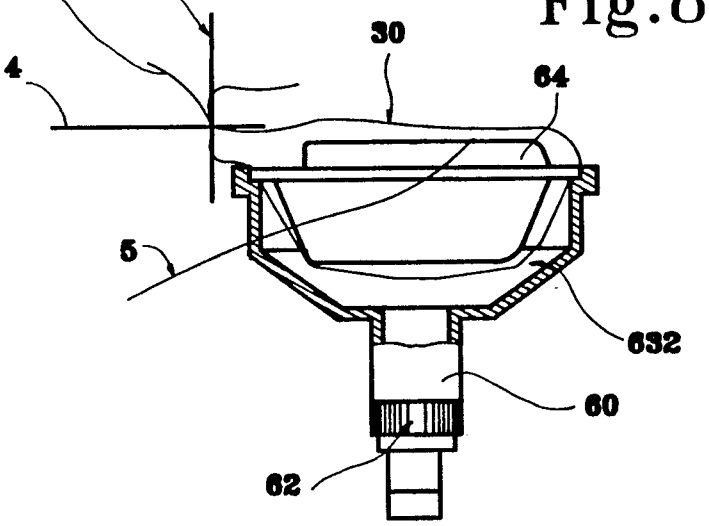
FIG. 8A is a sectional view taken along line 8A—8A of FIG. 8.

Referring to FIGS. 6, 6A, 7, 7A, 8, and 8A, a stitch is made by means of the operation of the shuttle/hook & bobbin assembly 6 and the needle 170 according to the following procedure:

a) The upper thread 3 is carried by the needle 170 to the position below the workpiece 4 (this stroke is the needle throw);

b) At the initial stage of the needle lifting stroke, the upper thread 3 is caused by the workpiece 4 to form a loop 30 in the rotating track of the thread hook 631 (see FIGS. 6 and 6A);

c) At the same time, the rotating shuttle 63 is rotated by the transmission shaft 190 to move the thread hook 631 into the loop 30 (see FIGS. 7 and 7A), causing the loop 30 to be carried into the gap 632 between the bobbin case 64 and the rotating shuttle 63 and then mounted around the bobbin case 64;

d) As the thread hook 631 moves over ½ run (see FIGS. 8 and 8A), it is immediately moved back, at the same time, the loop 30 of the upper thread 3 is moved over one half of the periphery of the bobbin case 64 and fastened around the under thread 5, and therefore the under thread 5 is fastened with a loop as the needle 170 is lifted to carry the upper thread 3 out of the bobbin case 64 along the other half of the periphery of the bobbin case 64;

e) The aforesaid steps are repeated again and again to make stitches on the workpiece 4 (a conventional thread tension guide is also provided for regulating the tension of the upper thread according to the nature of the workpiece).

As indicated, the gap 632 between the rotating shuttle 63 and the bobbin case 64 is requisite. The bobbin case 64 is retained in place by the pressure plate 65 so that the rotating shuttle 63 can be turned back and forth relative to the bobbin case 64. The under thread bobbin 66 is revolvably received inside the bobbin cap 67 within the bobbin case 64. The bobbin cap 67 comprises a thread hole 670, through which the under thread 5 of the under thread bobbin 66 is let off, an adjusting screw 671, and a clip 672 controlled by the adjusting screw 671 to regulate the tension of the under thread 5.

Figure 10:
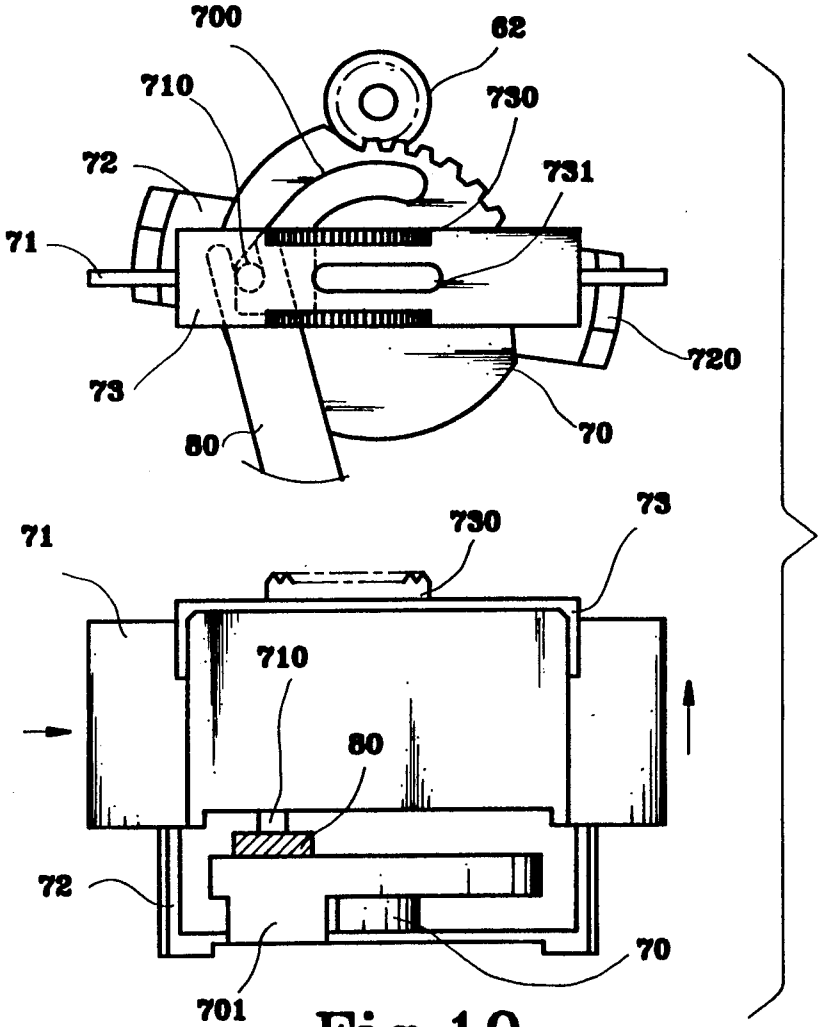
FIG. 10 illustrates the operation of the feed mechanism (step II; to feed the workpiece forward)
Figure 9:
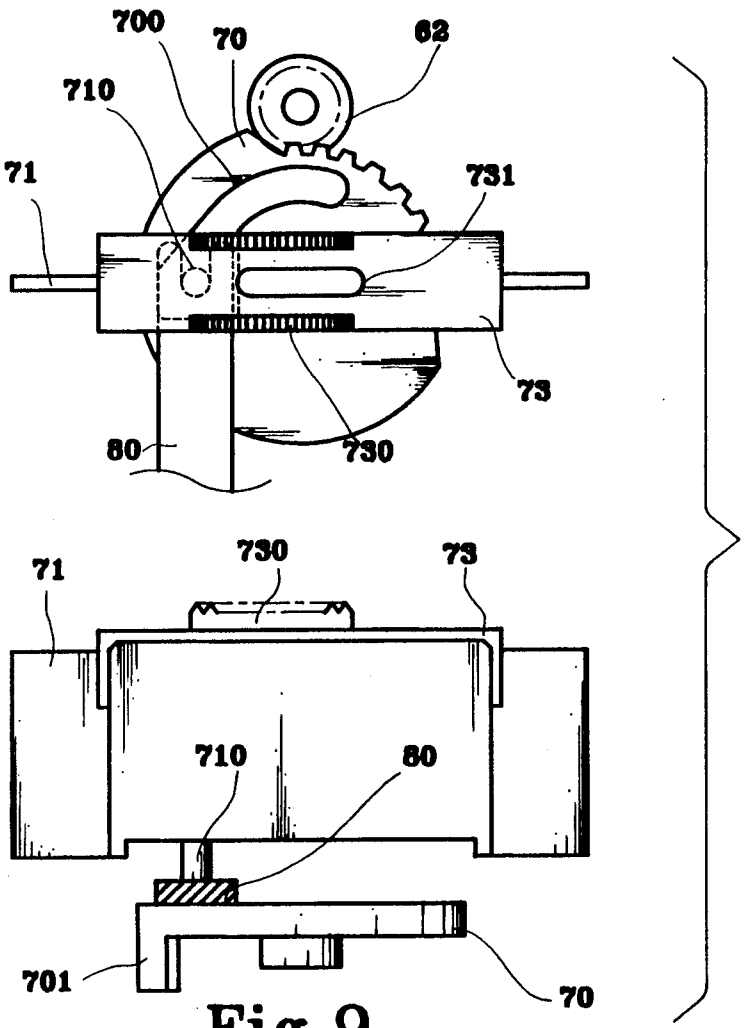
FIG. 9 illustrates the operation of the feed mechanism (step I; to retain the workpiece in place)
Figure 11:
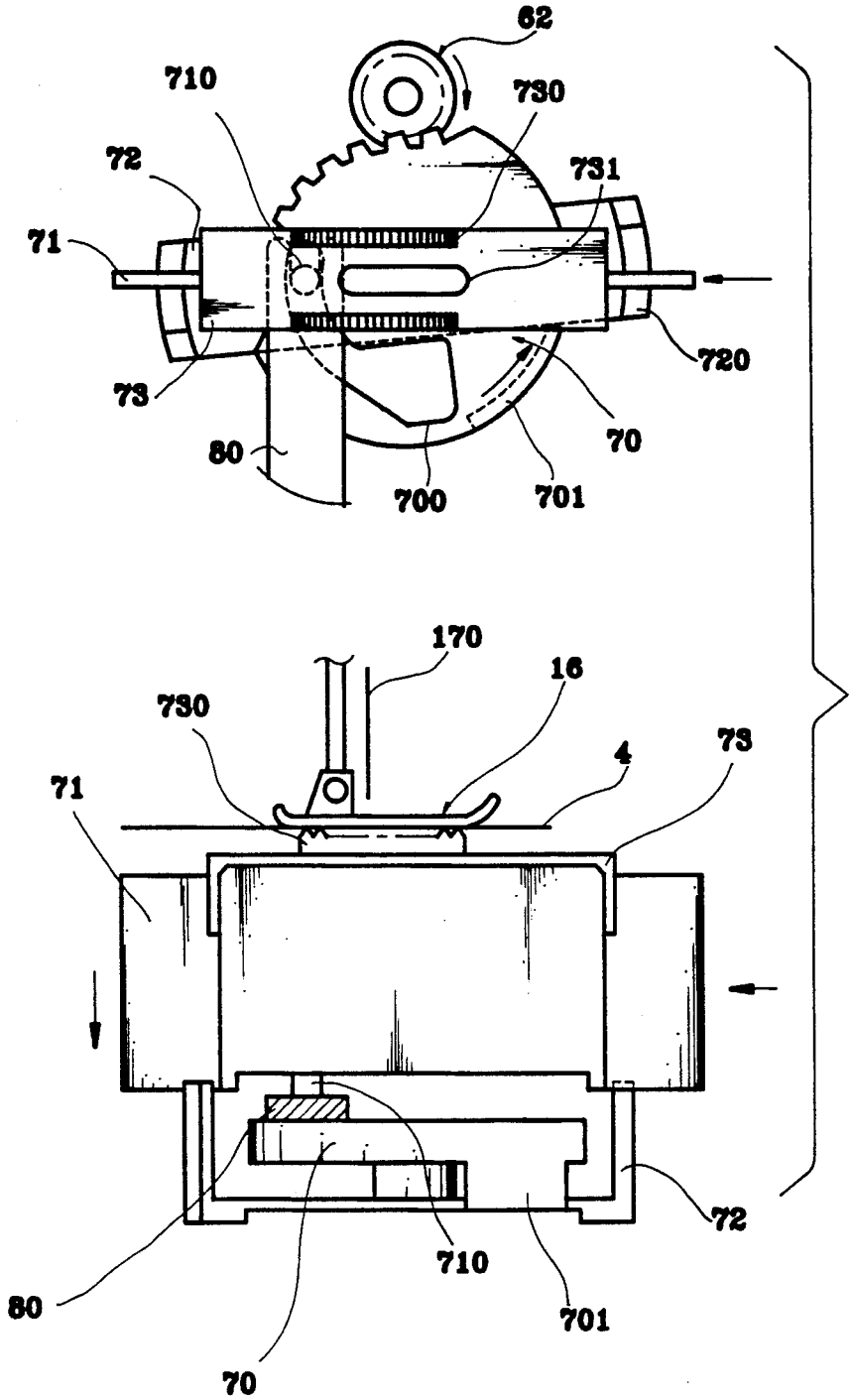
FIG. 11 illustrates the operation of the feed mechanism (step III; to feed the workpiece backward).

Referring to FIGS. 9, 10, 11, and FIGS. 3 and 4 again, the feed mechanism 7 comprises a gear 70 meshed with the spur gear 62 of the shuttle/hook & bobbin assembly 6. The gear 70 is turned back and forth alternatively by the spur gear 62. Therefore the tooth form of the gear 70 can be arranged in the shape of a sector gear. The gear 70 has a circularly curved, elongated guide slot 700 at an eccentric location for guiding a feed block 71, and a bottom flange 701 for moving a lifting bar 72. As the lifting bar 72 is moved by the bottom flange 701 of the gear 70, the feed block 71 is lifted by the lifting bar 72. There is a feed dog 73 mounted on the feed block 71 at the top, having two parallel rows of teeth 730 spaced by an oblong needle hole 731. The feed block 71 is supported above the base plate 20 and reciprocated by the gear 70 along the tangent touching the rotating stroke of the thread hook 631 of the rotating shuttle 63. Therefore, the aforesaid loop 30 is formed in the rotating track of the thread hook 631 as the needle 731 is lifted from the oblong needle hole 731.

The feed block 71 can be controlled by the micro-inch stitch adjusting device 8 to move the workpiece forwards or backwards and to control the stitch density (number of stitch per inch). If the driving pin 710 of the feed block 71 is moved to the mid point of the guide slot 700 by a lever 80 of the micro-inch stitch adjusting device 8, as shown in FIG. 9, the feed block 71 does not move when the gear 70 is turned back and forth alternatively (therefore, the needle 170 is reciprocated on the same point).

Referring to FIG. 10, if the driving pin 710 of the feed block 71 is moved to stop at the left end of the guide slot 700 by the lever 80, the lifting bar 72 is lifted by the bottom flange 701, and therefore the feed block 71 is simultaneously lifted by the top slope 720 of the lifting bar 72 to squeeze the workpiece 4 against the presser plate 16 (see FIG. 1). As the gear 70 is turned counterclockwise, the driving pin 710 is moved toward the right, causing the feed dog 73 to move the workpiece 4 forward for a next stitch. At the same time, the lifting bar 72 is moved by the opposite end of the bottom flange 701 for allowing the feed block 71 to come down along the slope 720 of the lifting bar 72 (see FIG. 11). After that, the gear 70 is turned clockwise to its former position, causing the border edge of the guide slot 700 to disconnect from the driving pin 710. At the same time, the feed block 71 is moved back to the position shown in FIG. 10, by the lever 80 by means of the operation of a spring 81, causing the feed dog 73 to engage the workpiece 4 again. If the driving pin 710 of the feed block 71 is moved to stop at the right end of the guide slot 700 by the lever 80, the lifting bar 72 is lifted by the bottom flange 701, and therefore the feed block 71 is simultaneously lifted by the top slope 720 of the lifting bar 72 to squeeze the workpiece 4 against the presser plate 16. Therefore, the workpiece 4 will be moved backwards as the gear 70 is turned back and forth alternatively.

Referring to FIG. 3 and 4 again, the micro-inch stitch adjusting device 8 further comprises a slide 82 made to slide in a dovetail groove 21 on the base plate 20, to which the aforesaid spring 81 is coupled, an eccentric shaft 83 turned to move the slide 82 in the dovetail groove 21. By turning the eccentric shaft 83 to move the slide 82 in the dovetail groove 21, the position of the driving pin 710 in the guide slot 700 is adjusted by the lever 80 for allowing the workpiece to be moved forward/backward or retained in place.

The stitch density can also be adjusted by controlling the position of the driving pin 710 in the guide slot 700. As the driving pin 710 is disposed closer to either end of the guide slot 700, the reciprocating stroke of the feed block 71 is relatively increased, and the pitch between stitches is widened, and therefore the stitch density is reduced. On the contrary, as the driving pin 710 is disposed closer to the mid point of the guide slot 700, the reciprocating stroke of the feed block 71 is relatively reduced, and the pitch between stitches is shortened, and therefore the stitch density is increased.

In order to retain the eccentric shaft 83 in position after each adjustment, a locating gear 84 is fastened around the eccentric shaft 83 and forced by a compression spring 85 to mesh with a ratchet 22 on the base plate 20. The locating gear 84 can be disengaged from the ratchet 22 for adjusting the position of the driving pin 710 by pressing the eccentric shaft 83 against the compression spring 85 and then turning the eccentric shaft 83 in either direction. As the external pressure is released from the eccentric shaft 83, the locating gear 84 is returned by the compression spring 85 to mesh with the ratchet 22 again.

I claim:

1. A sewing machine comprising a DC motor, a main shaft driven by said DC motor through a reduction gear to reciprocate a needle bar with a needle vertically, and a stitch making mechanism driven by said main shaft through a reciprocating mechanism and a transmission shaft to carry an under thread for making stitches on a workpiece with the upper thread being carried by the needle of said needle bar, wherein said stitch making mechanism comprises:

a shuttle/hook & bobbin assembly mounted on a base plate, said shuttle/hook & bobbin assembly comprising a revolving shaft coupled to said transmission shaft by bevel gears, a rotating shuttle integrally formed on said revolving shaft at the top, said rotating shuttle having a thread hook projected into a peripheral notch thereof, a bobbin case retained within said rotating shuttle by a pressure plate and spaced from said rotating shuttle by a gap, a bobbin cap disposed within said bobbin case, and an under thread bobbin revolvably received inside said bobbin cap, said pressure plate comprising a substantially C-shaped opening fitting over the periphery of said bobbin case and a projecting rod projected into said C-shaped opening to stop said bobbin case within said rotating shuttle;

a feed mechanism mounted on said base plate, said feed mechanism comprising a gear wheel alternatively turned back and forth by said revolving shaft of said shuttle/hook & bobbin assembly, a feed block having a driving pin at the bottom disposed in an elongated guide slot on said gear wheel and a feed dog at the top reciprocated by said feed block in a course tangent to said rotating shuttle for feeding the workpiece in either direction, and a lifting bar driven by a bottom flange on said gear wheel to lift or lower said feed block, the movement track of said feed block being in tangent to the movement track of said thread hook, the tangent point between the movement track of said feed block and the movement track of said thread hook being intersected with the moving track of said needle so that said needle carries the upper thread to form loops one after another at said tangent point for letting each loop be carried by said thread hook in said gap and then fastened around the under thread to make a respective stitch; and a micro-inch stitch adjusting device mounted on said base plate for controlling the stitch density and for controlling said feed dog to feed the workpiece in either direction or not to feed the workpiece, said micro-inch stitch adjusting device comprising a lever controlled by a spring and a slide to adjust the position of said driving pin in said guide slot, an eccentric shaft turned to move said slide in controlling the position of said driving pin.

2. The sewing machine of claim 1 wherein said thread hook of said rotating shuttle is turned in one direction to hook the loop of the upper thread being formed beneath the workpiece and to carry the loop over one half of the periphery of said bobbin case, and then turned in the reversed direction to let the loop be fastened around the under thread on said under thread bobbin and carried out of said gap along the other half of the periphery of said bobbin case.

* * * * *